United States Patent [19]

Goldberg et al.

[11] 4,251,063

[45] Feb. 17, 1981

[54] DEVICE FOR GUNITING THE LINING OF CASTING LADLES

[76] Inventors: Ilya A. Goldberg, prospekt Shaumiana, 47, kv. 35; Boris A. Kobtsev, prospekt Stachek, 57, kv. 49; Jury A. Polonsky, Krasnopuitolovskaya ulitsa, 129, kv. 49, all of Leningrad; Boris A. Velikin, 11 Parkovaya ulitsa, 44, korpus 4, kv. 77, Moscow; Mamuka S. Mindeli, Pionersky proezd. 8, Rustavi; Guram V. Kashakashvili, proezd Vazha Pshavela, 1, kv. 33, Rustavi; Shalva V. Popiashvili, ulitsa Sovetskaya, 17, kv. 37, Rustavi; Otar N. Suladze, Pionersky proezd. 3, Rustavi, all of U.S.S.R.

[21] Appl. No.: 62,173

[22] Filed: Jul. 30, 1979

[51] Int. Cl.[3] ..... C21B 7/04

[52] U.S. Cl. ..... 266/281; 264/30; 239/184; 239/227; 118/317

[58] Field of Search ..... 266/281, 287; 264/30; 239/226, 227, 184, 185, 186, 187; 118/317, 318, 319

[56] References Cited

U.S. PATENT DOCUMENTS

| | | | |
|---|---|---|---|
| 3,351,289 | 11/1967 | Demaison | 264/30 |
| 3,869,088 | 3/1975 | Dykmans | 239/186 |
| 3,914,077 | 10/1975 | Lodes | 239/186 |
| 3,973,730 | 8/1976 | Johnson | 239/227 |
| 4,099,708 | 7/1978 | Morris et al. | 266/281 |
| 4,163,546 | 8/1979 | Morris et al. | 266/281 |

FOREIGN PATENT DOCUMENTS

| | | | |
|---|---|---|---|
| 401742 | 2/1974 | U.S.S.R. | 264/30 |
| 448070 | 10/1974 | U.S.S.R. . | |

*Primary Examiner*—L. Dewayne Rutledge
*Assistant Examiner*—John P. Sheehan
*Attorney, Agent, or Firm*—Lackenbach, Lilling & Siegel

[57] ABSTRACT

Disclosed is a device for guniting the lining of casting ladles, comprising a platform which is mounted by means of adjustable supports on the ladle to be repaired. On the under side of the platform a guide is mounted so as to extend downward from the platform into the casting ladle. A carriage with a nozzle for supplying gunite onto the surface being repaired is mounted for reciprocating motion along the guide. The guide is fitted on sleds which, in turn, are set on a swivel table so as to permit radial displacement of the sleds relative to the axis of rotation of the swivel table, the swivel table being rotatably mounted on the platform. On the under side of the platform there is also arranged a detachable templet whose curvature is similar to the curvature of the horizontal cross-section of the ladle. A roller pair is mounted on the templet to run around it. The roller pair is coupled with the sleds in such a way that as the roller pair runs around the templet having, for example, on oval shape similar to the oval shape of the horizontal cross-section of the ladle, the sleds are displaced in a radial direction with respect to the axis of rotation of the swivel table. This results in a radial displacement of the guide with the carriage carrying the nozzle for supplying the gunite. The plate of the guide, supporting the carriage with the nozzle moving therealong, has a curvature corresponding to the curvature of the casting ladle lining. Thus, the rotation of the swivel table and the displacement of the carriage along the plate of the guide enable a constant distance between the nozzle fixed on the carriage and the lining of the casting ladle to be maintained.

2 Claims, 14 Drawing Figures

DEVICE FOR GUNITING THE LINING OF CASTING LADLES

FIELD OF THE INVENTION

The present invention relates to metallurgy and, more particularly, to devices for guniting the lining of casting ladles.

BACKGROUND OF THE INVENTION

Present day metallurgical processes involving extensive use of oxygen are characterized by generation of high temperatures and corrosive effect of the molten slag, the metal and the gas atmosphere on the refractory lining of the metallurgical set and, particularly, on the lining of the casting ladles. In addition, a non-uniform distribution of thermal loads over the lining surface of the casting ladles results in local lining damages, and the failure of even a single unit of the lining invariably causes a shutdown of the metallurgical set for long-term repair.

To prolong the life of the refractory lining and to provide for stable operation of the metallurgical plant, a great emphasis is placed in maintenance both in the cold and hot conditions.

One of the most advanced methods of repairing the lining of the metallurgical plants is guniting which enables the repair of the lining surface to be performed both in the cold condition and at high temperatures.

The basic nature of the guniting process is coating of the lining surface to be repaired with a moistened granular mixture. The gunite is laid on the damaged areas in thin uniform layers by means of special devices called cement guns from which the gunite is delivered by compressed air along a hose provided with a nozzle at its end, and is deposited by the imparted kinetic energy onto the surface to be repaired.

The present day devices for guniting the casting ladles are very labor consuming, since for repairing the lining of the ladle the repairman has to control the nozzle manually, not infrequently within the ladle where the temperature reaches the level of 80° to 100° C., in an extremely dusty atmosphere.

DESCRIPTION OF THE PRIOR ART

Also known in the prior art are automated devices for guniting the lining of casting ladles, which provide, to a certain extent, more favorable labor conditions when performing the guniting process (cf. USSR Inventor's Certificate No. 448070, Int. Cl. B 22 41/02). This device comprises a platform having a guide with a carriage mounted thereon and provided with a gunite delivering nozzle. The guide is formed by a column mounted on a trolley which is capable of moving along the platform. The platform, in turn, can slide along the guide rails. The nozzle is mounted on the carriage by means of a movable rod.

The guniting of the lining surfaces is performed when raising and lowering the nozzle-carrying rod, displacing the carriage along the colomn and moving both the platform and the trolley.

Such a device, however, fails to provide a simple manipulating of the nozzle due to multiple mutual displacements of the elements of the device, such as raising and lowering the rod, rotating the nozzle, and displacing the platform and the carriage with respect to each other). This results in a time-consuming work when guniting local damages of the lining of a casting ladle, since moving to each new lining area requires arresting and realignment of the device.

Moreover, intricate manipulating of the nozzle complicates the use of automation means for providing remote control of programmed guniting process.

The repairman, therefore, has to remain onto the platform of the device, where the control mechanisms are arranged, i.e. in the immediate vicinity of the ladle to be repaired. It prevents such a device from being used for hot repair of the lining of the casting ladles, as the temperature of the ladle being repaired goes as high as 400° C. during hot repair.

Moreover, such a device fails to provide a complete guniting of the entire surface of the lining of the walls and bottom of the casting ladle within one operating cycle without the necessity of realignment, since after the guniting of the ladle walls by means of such a device has been completed, it is necessary to replace the nozzle by a new one specially adapted for guniting the bottom of the ladle.

Furthermore, when using the prior art devices it is rather difficult to obtain a uniform guniting of complex-shaped casting ladles, specifically, of casting ladles having elliptical side surfaces.

Among the disadvantages of the prior art devices for automated guniting of the lining of casting ladles is that they are stationary units having large sizes, which makes it difficult to locate them in the regions of the casting ladles to be repaired.

SUMMARY OF THE INVENTION

It is an object of the present invention to overcome the abovementioned disadvantages of the prior art devices for guniting the lining of casting ladles.

Another object of the present invention is to provide a device for guniting the lining of casting ladles ensuring the ease of handling the nozzle and suitable for application of simple automation means.

Still another object of the present invention is to provide a device for guniting the lining of casting ladles ensuring a high efficiency of the guniting process by virtue of the possibility to perform the guniting of the walls and bottom of the ladle within one operating cycle without realignment of the operating member of the device.

Yet another object of the present invention is to provide a device for guniting the lining of casting ladles enabling uniform guniting of complex-shaped casting ladles to be performed.

Still another object of the present invention is to provide a portable device for guniting the lining of casting ladles, easily mountable on the casting ladle to be repaired, which does not require much space in the area of repair of the casting ladle.

With these and other objects in view, there is proposed a device for guniting the lining of casting ladles, comprising a platform with a carriage mounted thereon by means of a guide and having a nozzle for supplying the gunite. According to the invention, the guide has a curvature corresponding to the curvature of the lining of the casting ladle, is mounted on the platform so as to extend downward from the platform into the casting ladle, is capable of rotation about its vertical axis and is coupled to a means mounted on the platform and adapted for radial displacement of the guide with respect to said vertical axis, the platform being provided with adjustable supports for fixing it on the ladle.

Such a construction of the device for guniting the lining of casting ladles, with the guide having a curvature corresponding to the curvature of the casting ladle lining and disposed below the platform, i.e. within the inner space of the ladle to be repaired as the device is mounted on the casting ladle, considerably simplifies the handling of the nozzle for supplying the gunite. During the guniting process, the nozzle mounted on the carriage moving along such a guide can be rapidly displaced over a path providing for easy access for guniting to any point of the lining surface, including the ladle bottom. Such a rapid displacement of the nozzle is provided by combination of two movements, i.e. a reciprocal movement along the guide and a rotational movement together with the guide.

Furthermore, the means for radial displacement of the guide relative to its vertical axis, mounted on the platform, enables a constant distance between the surface of the lining and the nozzle to be maintained when moving the nozzle together with the guide during the guniting of complex-shaped ladles, e.g. elliptical ladles.

At the same time, the proposed embodiment of the device for guniting the lining of casting ladles, whose platform has adjustable supports for mounting the device on the casting ladle to be repaired, imparts portability to this device, i.e. the device can be readily mounted on one ladle to be repaired and after the completion of guniting it can be easily removed and transferred to another ladle. Such a construction ensures higher efficiency of labor with respect to the prior art stationary devices, as well as a significant decrease in maintenance floor area.

Moreover, the supports of the device are adjustable, thereby permitting the same device to be used for repairing the casting ladles of different capacities, i.e. having different diameters and depths.

It is advisable to embody the means for radial displacement of the guide as sleds movably mounted on the underside of the platform and carrying said guide. A detachable templet is mounted on the under side of the platform, the templet having a curvature similar to the curvature of the horizontal cross-section of the ladle and carrying a roller pair coupled to the sleds.

Such a construction of the means for radial displacement of the guide provides for the most easy way to maintain a constant distance between the surface of the lining of elliptically shaped ladles and the nozzle.

These and other objects and novel features of the present invention are set forth in the appended claims and the present invention as to its construction and its mode of operation will best be understood from a consideration of the following detailed description of the preferred embodiments when used in connection with the accompanying drawings which are hereby make a part of the specification.

DETAILED DESCRIPTION OF THE INVENTION

Figure 1:
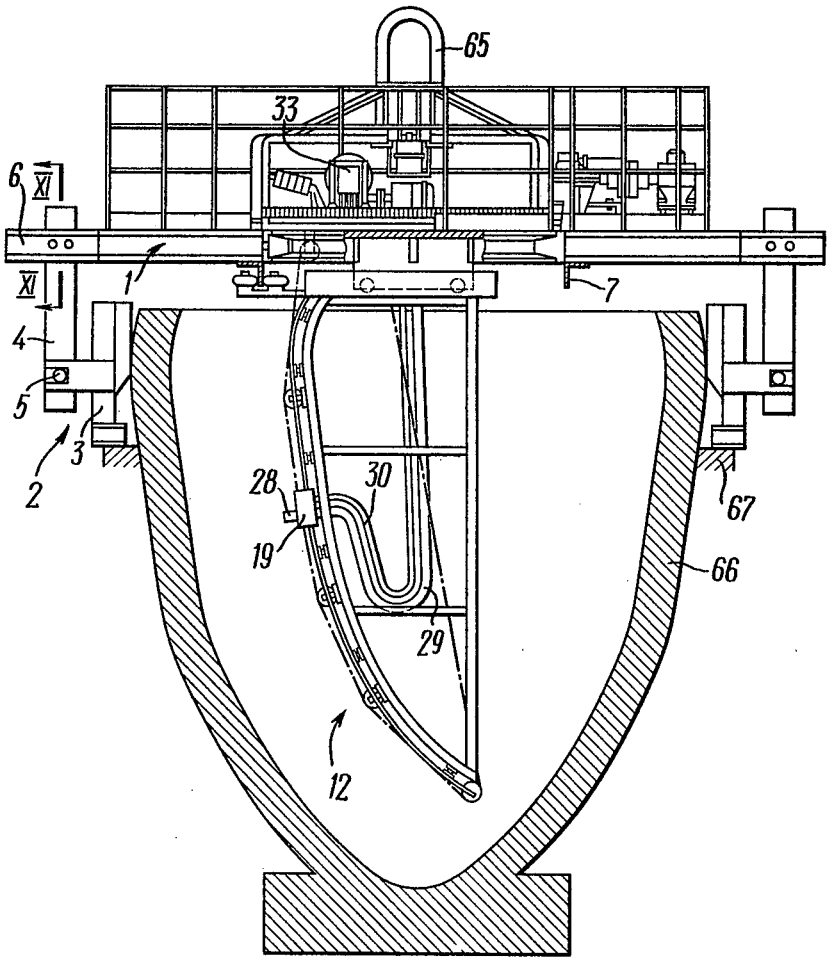
FIG. 1 is a front view, partially in section of a device adapted for guniting the lining of casting ladles and on which a casting ladle is mounted according to the invention.
Figure 2:
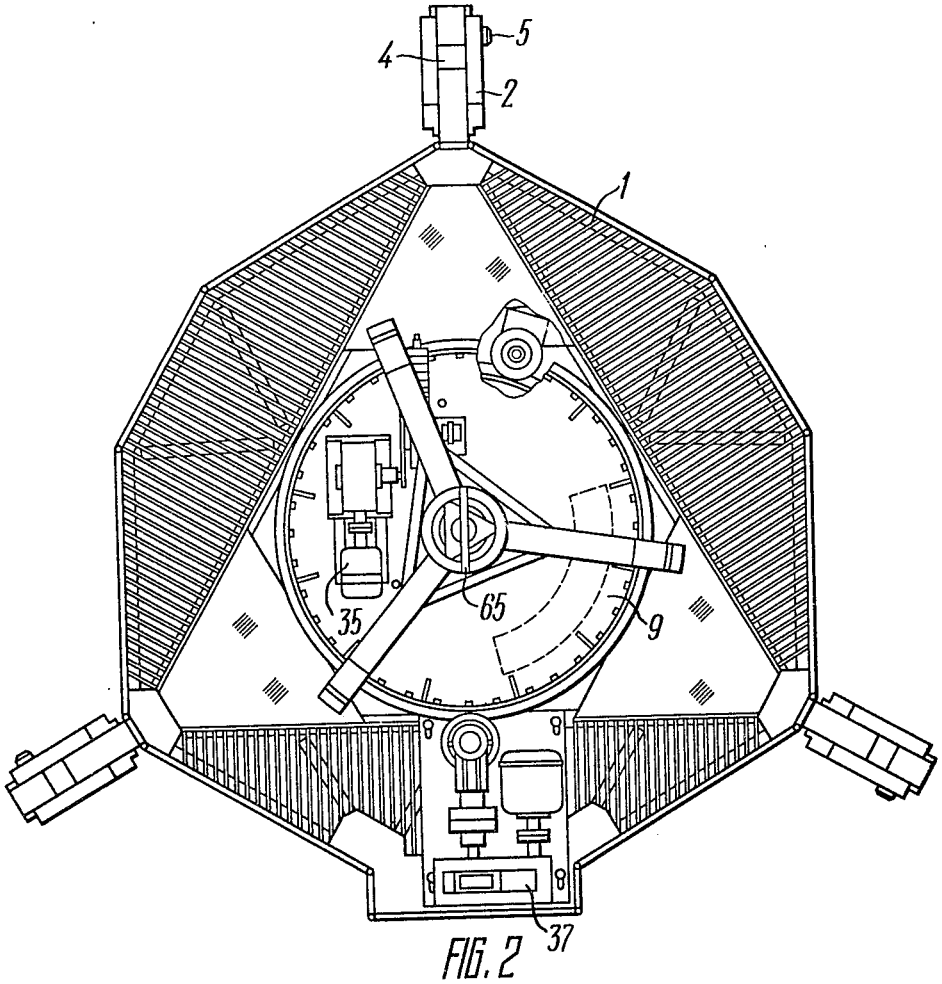
FIG. 2 is a top view of a device for guniting the lining of casting ladles.
Figure 3:
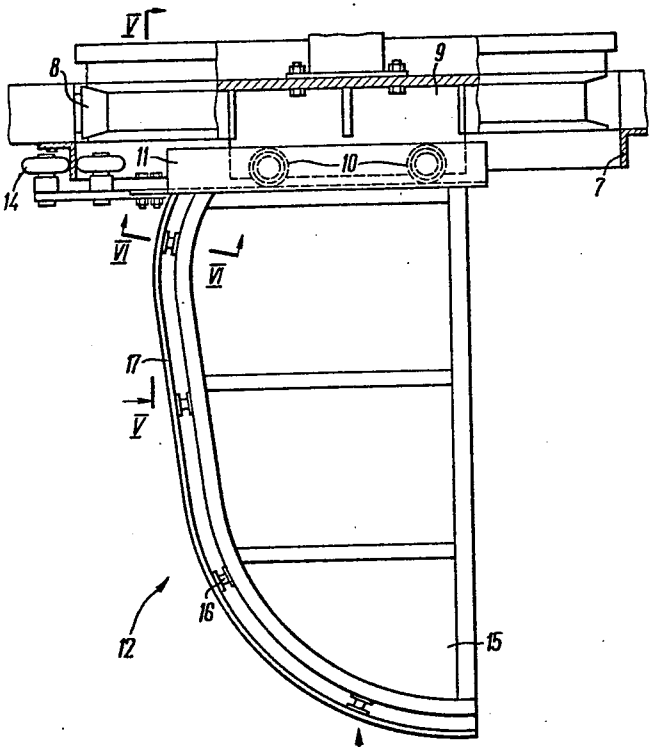
FIG. 3 is a side view, partly broken away illustrating the guide in combination with the means for its radial displacement.

Referring now to FIGS. 1 and 2, the device for guniting the lining of casting ladles comprises a platform 1 provided with adjustable supports 2 designed as swivel claws 3 fixed to stands 4 by means of pivots 5. The stands 4 of the supports 2 are fixed between channels 6 of the platform 1. A detachable templet 7 (FIG. 3) and a swivel table 9, provided with a toothed ring (not shown) and mounted by means of tapered rollers 8, are arranged in the central part of the platform 1.

Fixed to the lower side of the swivel table 9 are rollers 10, sleds 11 (FIGS. 3, 4 and 5) being movable on said rollers. The sleds 11 carry a guide 12 and a roller pair 13 (FIG. 4) whose rollers 14 are mounted for running along the outer and inner surfaces of the templet 7.

Figure 6:
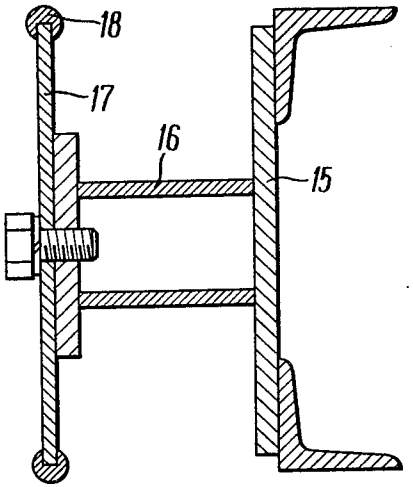
FIG. 6 is a sectional view taken along line VI—VI of FIG. 3 and illustrating attachment of the curved plate to the box.

The guide 12 is formed by a box 15 (FIG. 3) with a detachable curved plate 17 mounted to the walls of the box 15 by means of brackets 16 (FIG. 6). Round rods 18 are welded to the side edges of the plate 17.

A carriage 19 (FIGS. 7, 8 and 9) is movably mounted on the guide 12 (FIG. 1).

Figure 7:
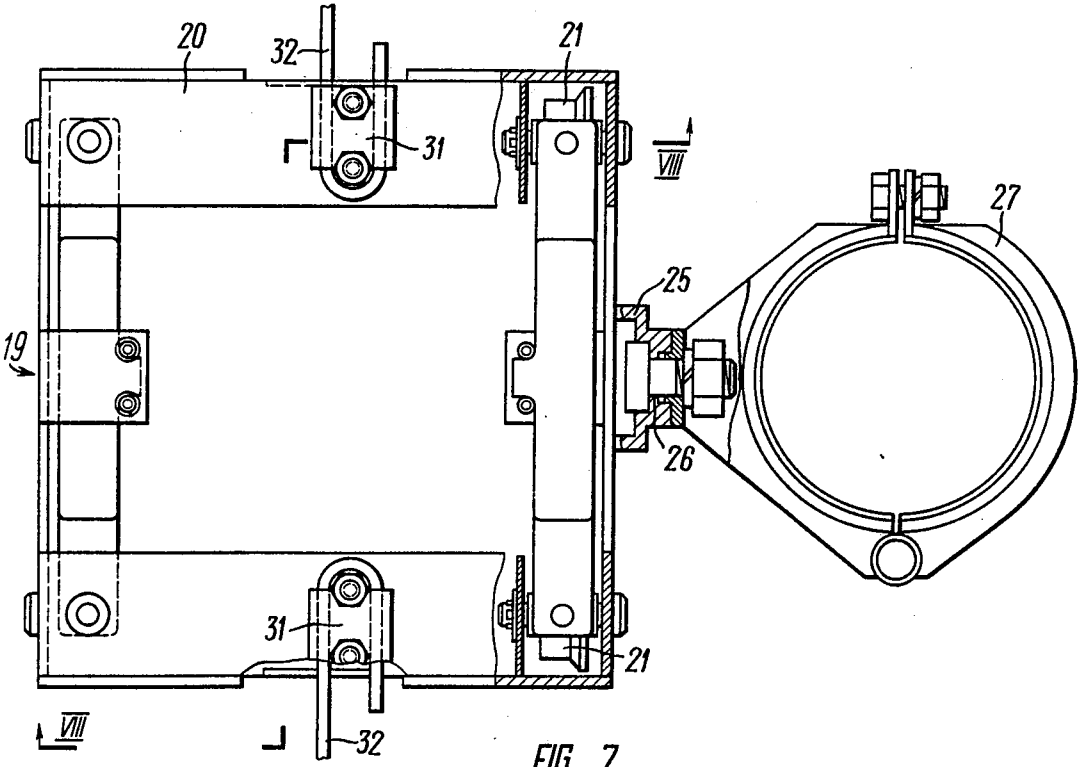
FIG. 7 is a top view of a carriage.
Figure 8:
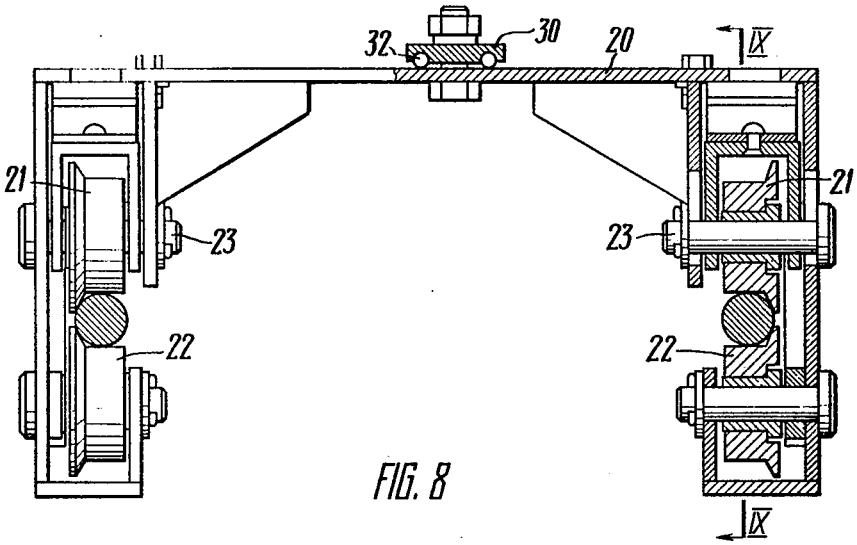
FIG. 8 is a sectional view taken along line VIII—VIII of FIG. 7.
Figure 9:
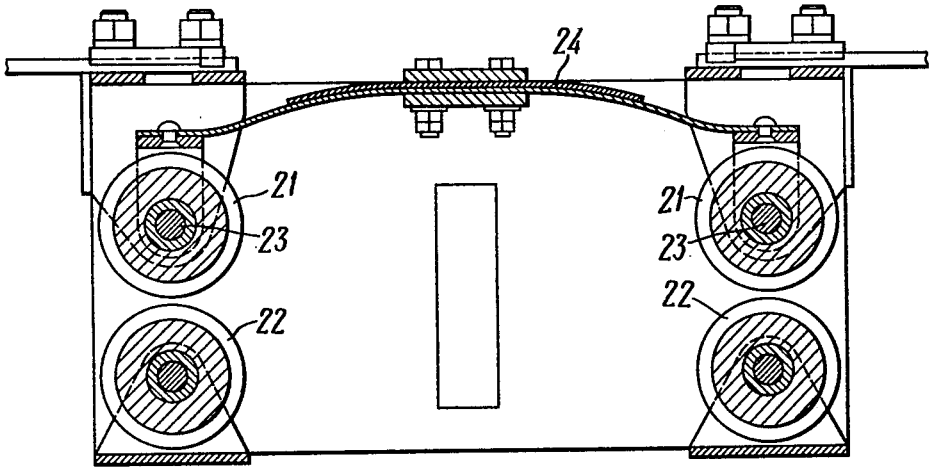
FIG. 9 is a sectional view taken along line IX—IX of FIG. 8.

A casing 20 (FIG. 7) of the carriage 19 accommodates four rotatable rollers 21 and four fixed rollers 22 (FIG. 8). Shafts 23 of the rotatable rollers 21 are fitted to a leaf spring 24 (FIG. 9).

Set upon the casing 20 (FIG. 7) of the carriage 19 is a guide 25 (FIG. 7) having a slot accommodating a slide 26 of a collar 27 used for clamping a nozzle 28 (FIG. 1) to which a hose 29 for supplying gunite and a hose 30 for supplying moisturing agent are connected.

The ends of a cable 32 are fixed to the casing 20 of the carriage 19 by means of cover-plates 31 (FIG. 7).

Figure 10:
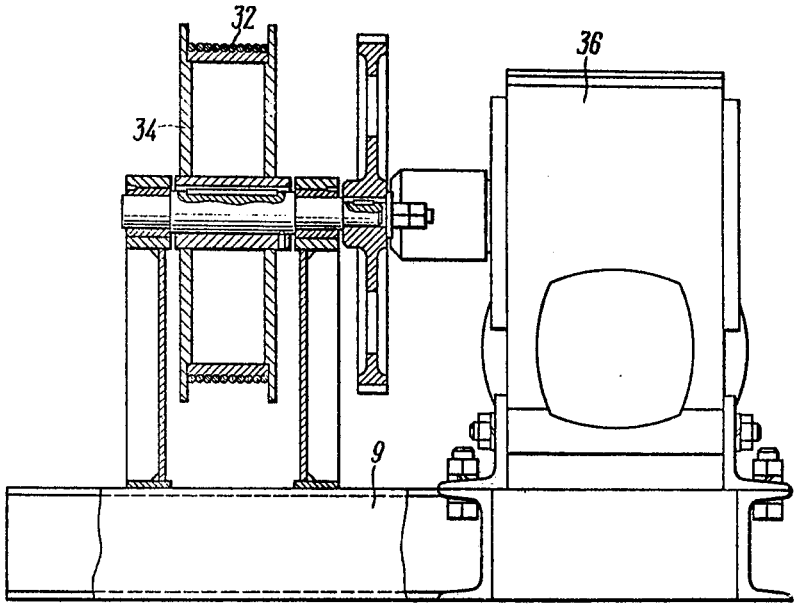
FIG. 10 is an elevational view of a carriage transfer mechanism.

A carriage transfer mechanism 33 (FIG. 1) comprises a drum 34 (FIG. 10) for winding the cable 32, an electric motor 35 (FIG. 2) and a reduction gear box 36 (FIG. 10).

A reversible electric drive 37 (FIG. 2) is arranged on the platform 1 and used to rotate the swivel table 9.

The stands 4 of the supports 2 of the platform 1 are fixed between the channels 6 (FIG. 1) by bolts 38

Figure 11:
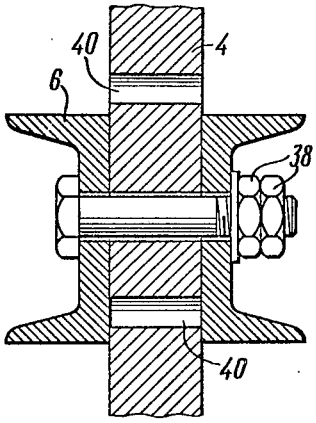
FIG. 11 is an enlarged sectional view taken along line XI—XI of FIG. 1 and illustrating an adjustable support.
Figure 12:
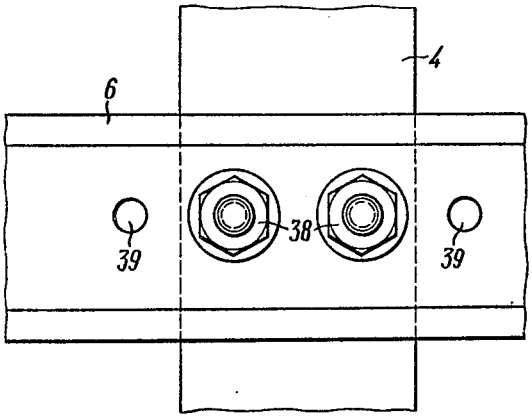
FIG. 12 is a side view of the adjustable support shown in FIG. 11.

(FIGS. 11 and 12) passing through holes 39 in the channels 6 and holes 40 in the stands 4.

Figure 13:
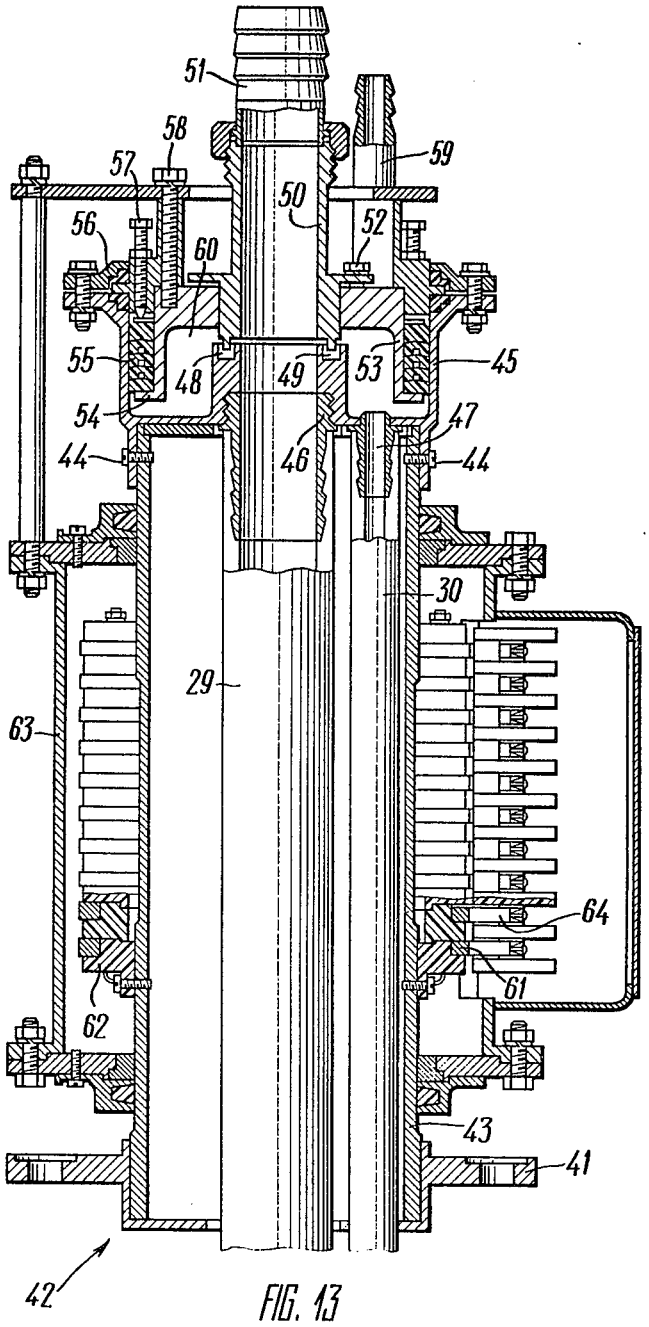
FIG. 13 is a longitudinal sectional view of a collector.

On the swivel table 9 (FIG. 10) there is mounted, by means of a bearing flange 41 (FIG. 13), a collector 42 incorporating a tube 43 with a barrel 45 bolted to its upper end at 44. The barrel 45 is provided with a pipe connection 46 to receive gunite hose 29, and with a pipe connection 47 to receive moisturing agent hose 30. An annular groove 48 cut in the barrel 45 receives a bearng ring 49 made from polytetraflurethylene. Said bearing ring 49 supports a sleeve 50 provided with a pipe connection 51, the hose (not shown) of the guniting device (not shown) being connected thereto. The sleeve 50 is bolted to a cup 53 at 52, said cup having a rim 54 supporting cuffs 55 made from plytetrafluorethylene. The cuffs 55 are tightened through a ring 56 by bolts 57. The cup 53 is joined to the platform 1 by means of bolts 58. A pipe connection 59 is threaded into the cup 53, the moisturing agent hose (not shown) being connected thereto.

The moisturing agent is delivered from the stationary hose (not shown) to the rotating hose 30 via a sealed chamber 60 formed by the barrel 45 and the cup 53.

Current conducting rings 61 separated by insolating spacers 62 are fixed on the tube 42 and are covered with a dismountable guard 63. The power is supplied to the current conducting rings 61 through brushes 64.

The platform 1 (FIGS. 1 and 2) is provided with a clamp 65 used for mounting the guniting device on the ladle 66 (FIG. 1) to be repaired, said ladle having a stiffening ring 67.

Figure 14:
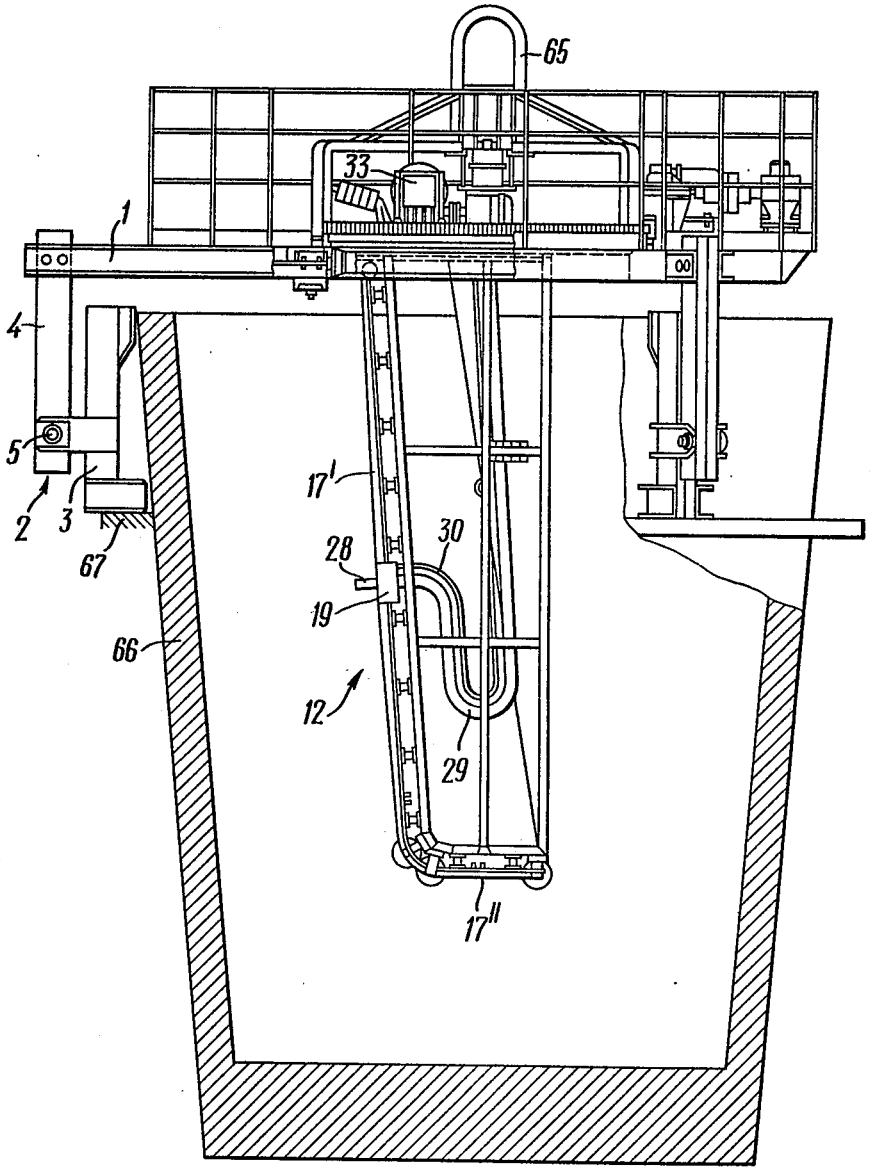
FIG. 14 is a front view of another embodiment of the device adapted for guniting the lining of casting ladles and comprising the guide consisting of rectilinear portions.

Another embodiment of the invention is illustrated in FIG. 14 wherein parts corresponding to those already described have the same reference numerals for ease of understanding the similiarities and differences of the two embodiments.

According to this embodiment, the device for guniting the lining of casting ladles is designed for guniting frustum-shaped ladles.

The distinguishing feature of this embodiment consists in that the curved plate 17 of the guide 12 is replaced by two articulated rectilinear plates, one of the plates 17′ being arranged parallel to the generatrix of the ladle 66, while the other plate 17″ is arranged in parallel to the bottom of the ladle 66.

The guniting process utilizing the proposed guniting device is performed as follows.

When the oval-shaped casting ladles are subjected to guniting, a curved plate 17 is mounted on the guide 12 (FIG. 3), the curvature of the plate 17 corresponding to the curvature of the walls of the ladle (FIG. 1).

The supports 2 are adjusted according to the diameter and height of the casting ladle to be repaired. The adjustment is performed by displacing the stands 4 relative to the channels 6.

To adjust the stand 4 in a horizontal plane, the bolted joint 38 (FIG. 12) is unscrewed and the stand 4 is then moved and fixed to a respective channel 6 and is locked by a bolted joint 38 passing through the hole 39 of the channel. To adjust the stand 4 vertically, the bolted joint 38 is unscrewed and the stand 4 is moved vertically and then fixed at a desired position by means of a bolted joint 38 passing through respective holes 40 of the stands (see FIG. 11).

Held by the clamp 65, the device is lifted by a hoisting crane (not shown) and is installed on the ladle 66. The swivel claws 3 bear up against the ladle 66, turn and take the vertical position while being lowered onto the ladle. Then they are placed on the upper stiffening ring 67 of the trunnion band of the ladle 66.

The gunite supply hose (not shown) of the guniting device (not shown) is joined to the pipe connection 51, and the moisture supply hose (not shown) is joined to the pipe connection 59.

The gunite is fed to the nozzle 28 through the duct formed by the sleeve 50, the central hole of the barrel 45, the pipe connection 45 and the hose 46.

The moisture is delivered under pressure through the sealed cavity 60.

The power is supplied via the copper-carbon brushes 64 to the rotating current conducting rings 61 connected to the electric motor 35.

As has been stated hereinabove, the guniting device of the invention ensures the guniting of the local lining damages as well as the guniting of the whole surface of the lining, including the bottom lining.

When the local damages of the ladle lining are being repaired, the nozzle 28 is neared to the damaged area by moving the carriage 19 along the guide 12 and rotating at the same time the swivel table 9. The guniting is performed by reversing the movement of the swivel table 9 at a certain angle and reciprocating the carriage 19.

The swivel table 9 is rotated via the toothed ring (not shown) by the reversing electric drive 37. The reciprocating of the carriage 19 is carried out by means of the cable 32 pulled by the drum 34 of the carriage transfer mechanism 33.

As mentioned hereinabove, one of the advantages of the present invention is that it enables the uniform guniting of the lining of complex-shaped, for example elliptical, casting ladles to be performed.

Figure 4:
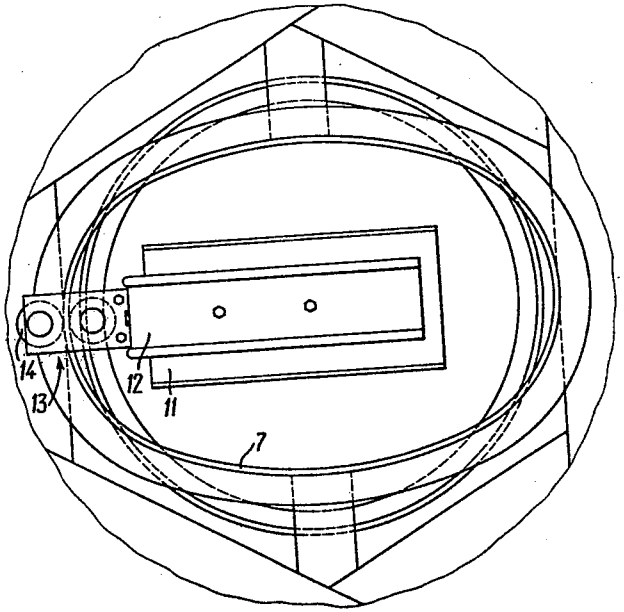
FIG. 4 is a bottom view of the guide in combination with the means for its radial displacement, looking in the direction of arrow A of FIG. 3.
Figure 5:
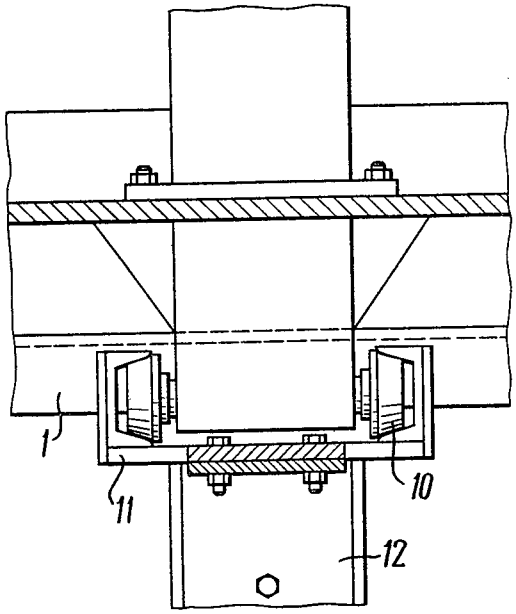
FIG. 5 is a sectional view taken along line V—V of FIG. 3 and illustrating attachment of the guide to the sleds.

As shown in FIG. 4, the detachable templet 7 is mounted on the under side of the platform 1 and has ellipticity similar to the ellipticity of the ladle in a horizontal plane. Upon rotating the swivel table 9, the rollers 14 of the roller pair 13 run along the templet 7, thus causing radial displacement of the sleds 11 and the guide 12 fixed thereto relative to the axis of rotation of the swivel table 9. This enables a constant distance between the nozzle 28 moving along the guide 12 and the wall of the ladle 66 to be maintained.

When guniting the lining of a frustum-shaped ladle, as shown in FIG. 14, rectilinear articulated plates 17′ and 17″ are mounted on the guide 12, arranged in parallel to the generatrix of the ladle wall and to the bottom of the ladle, respectively.

The nozzle 28 moving along these plates 17′ and 17″ is always held at the same distance from the lining of the ladle, thereby permitting uniform depositing of the gunite onto the lining.

As stated above, another advantage of the present invention is that it enables remote control of the device to be performed from a control panel (not shown). During the guniting process the carriage is manipulated by combination of only two movements, namely the movement of the drum 54 and the movement of the swivel table 9, thereby permitting programmed control of the process with the use of simple automatic means (not shown).

Thus, the present invention offers an improved efficient device for guniting the lining of casting ladles, which is simple and reliable in guniting the lining of casting ladles of various sizes and shapes. The device of the present invention for guniting the lining of casting ladles enables the guniting process to be automated, thus substantially decreasing the servicing effort and eliminating harmful effect on the service personnel.

In the description of the foregoing embodiments of the present invention, specific narrow terminology has been resorted to for the sake of clarity. It should be understood, however, that the present invention is no way limited to the terms so selected and that each such term covers all equivalent elements operating in a similar manner and employed for solving similar problems.

Though the present invention has been described herein with reference to preferred exemplary embodiments thereof, it will be understood that minor changes in the device for guniting the lining of casting ladles may be made without departing from the spirit and scope of the invention, as will be readily understood by those skilled in the art.

All these alternations and changes will be considered to remain within the limits of the spirit and scope of the invention.

What is claimed is:

1. In a device for guniting the lining of casting ladles, comprising a platform with a carriage mounted thereon by means of a guide and having a nozzle for supplying the gunite, an improvement comprising a guide having a curvature corresponding to the curvature of the lining of the casting ladle, being mounted on the platform so as to extend downward from the platform into the casting ladle, and being rotatable about its vertical axis; means mounted on the platform for effecting radial displacement of the guide with respect to said vertical axis; and adjustable supports on said platform for fixing said platform on the ladle.

2. A device for guniting the lining of casting ladles according to claim 1 wherein the means for radial displacement of the guide includes sleds movably mounted on an underside of the platform, a templet having a curvature similar to that of the horizontal cross-section of the ladle, and a roller pair coupled to the sleds and interacting with inner and outer surfaces of said templet.

* * * * *